United States Patent [19]

Germanaud et al.

[11] Patent Number: 4,859,357

[45] Date of Patent: Aug. 22, 1989

[54] POLYFLUORINATED COMPOUNDS, THEIR PREPARATION AND THEIR USE AS LUBRICANT ADDITIVES

[75] Inventors: Laurent Germanaud, Irigny; Marc Hermant, Cormeilles-en-Parisis, both of France

[73] Assignee: Societe Atochem, Puteaux, France

[21] Appl. No.: 204,602

[22] Filed: Jun. 9, 1988

[30] Foreign Application Priority Data

Jun. 19, 1987 [FR] France ..... 87 08663

[51] Int. Cl.[4] ..... C10L 133/04

[52] U.S. Cl. ..... 252/51; 252/58; 564/503; 564/510

[58] Field of Search ..... 252/51, 58; 564/503, 564/510

[56] References Cited

U.S. PATENT DOCUMENTS

| | | | |
|---|---|---|---|
| 3,873,619 | 3/1975 | Luca et al. | 564/503 |
| 4,409,001 | 7/1982 | Sung | 44/71 |

FOREIGN PATENT DOCUMENTS

| | | |
|---|---|---|
| 0083077 | 6/1983 | European Pat. Off. . |
| 0248697 | 10/1983 | European Pat. Off. . |
| 2520377 | 1/1984 | France . |
| 2125063A | 2/1984 | United Kingdom . |

*Primary Examiner*—Jacqueline V. Howard

*Attorney, Agent, or Firm*—Stevens, Davis, Miller & Mosher

[57] ABSTRACT

The invention relates to new polyfluorinated compounds which are usable as anti-wear additives for lubricants.

These compounds are of general formula:

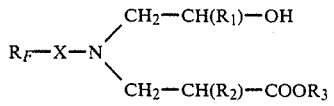

in which $R_F$ is a perfluorinated radical, X denotes a divalent linkage—$(CH_2CF_2)_a(CH_2)_b$—, —CF=CH—$CH_2$— or —CFH—$CH_2CH_2$—, a is an integer ranging from 0 to 10, b is an integer ranging from 1 to 4 but equal to 2 if a is other than zero, $R_1$ denotes a hydrogen atom or an alkyl radical, $R_2$ denotes a hydrogen atom or a methyl radical and $R_3$ denotes an alkyl radical. They are prepared by condensing an amino alcohol, $R_F$—X—NH—$CH_2CH(R_1)OH$, with an alkyl ester of an unsaturated carboxylic acid, $CH_2$=$C(R_2)$—$COOR_3$.

18 Claims, No Drawings

POLYFLUORINATED COMPOUNDS, THEIR PREPARATION AND THEIR USE AS LUBRICANT ADDITIVES

FIELD OF THE INVENTION

The present invention relates to fluorinated products and that of lubricants. It relates more especially to new fluorinated compounds which are usable as anti-wear additives for lubricants.

BACKGROUND OF THE INVENTION

It is already known to incorporate certain organofluorine derivatives in lubricants for the purpose of improving their anti-wear properties. Thus, for example, in French Patent No. 2,520,377, the incorporation of amines or amino alcohols having a polyfluorinated chain has been proposed. However, although these compounds enable lubricant compositions possessing exceptional anti-wear properties and an exceptional friction-reducing power to be obtained, their use is often limited due to their high volatility. This leads to a decrease in their efficacy with the passage of time.

SUMMARY OF THE INVENTION

It has now been found that this drawback can be substantially remedied by using, as fluorinated anti-wear additives, the compounds corresponding to the general formula:

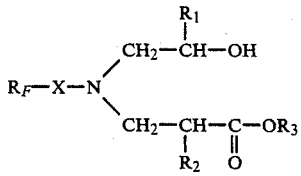

(I)

in which:

$R_F$ denotes a perfluorinated radical, preferably a linear or branched perfluoroalkyl radical containing from 2 to 20 carbon atoms, X denotes a linkage $-(CH_2CF_2)_a(CH_2)_b-$, $-CF{=}CHCH_2-$ or $-CFHCH_2CH_2-$, a is an integer ranging from 0 to 10, and preferably from 0 to 3, b is an integer which can range from 1 to 4, but is equal to 2 when a is other than 0, $R_1$ denotes a hydrogen atom or a linear or branched alkyl radical containing from 1 to 12 carbon atoms, $R_2$ denotes a hydrogen atom or a methyl radical, and $R_3$ denotes a linear or branched alkyl radical containing from 1 to 24 carbon atoms.

DETAILED DESCRIPTION OF THE INVENTION

Among the compounds of formula (I), more special preference is given to those in which $R_F$ is a linear perfluoroalkyl radical containing from 6 to 16 carbon atoms, X is a linkage $-CH_2CH_2-$, $-CF{=}CHCH_2-$ or $-CFHCH_2CH_2-$, $R_1$ and $R_2$ are hydrogen atoms and $R_3$ is an alkyl radical with 8 to 18 carbon atoms.

According to the present invention, it is possible to use a single compound of formula (I) or a mixture of these compounds. From the economic standpoint, it is, in particular, especially advantageous to use an industrial mixture of compounds having different groups $R_F$, x and/or $R_3$.

Generally speaking, the compounds of formula (I) may be obtained by condensing an amino alcohol of formula:

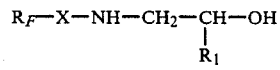

(II)

with an acrylic ester of formula:

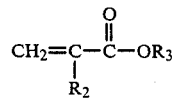

(III)

in which formulae the symbols $R_F$, X, $R_1$, $R_2$ and $R_3$ have the same meanings as above.

The addition of non-fluorinated amines to $\alpha,\beta$-unsaturated esters or amides has been known for a long time. See, for example, J. Chem. Soc., p 343 and 469 (1970) and J. Amer. Chem. Soc., 2533 (1949). These known methods may be applied to the condensation of the amino alcohols of formula (II) with the esters of formula (III). This condensation can, in particular, be performed at a temperature of between 20° and 120° C., and preferably between 20° and 80° C. It can be carried out in the absence of solvent, but is preferably conducted in a solvent for the ester and the amino alcohol used. This solvent is preferably a low molecular mass ($C_1$–$C_4$) alcohol, but may also be chosen from ethers, nitriles and mixtures thereof, especially an ether-/acetonitrile mixture. The condensation takes place satisfactorily in the absence of catalyst, but the reaction may be accelerated by adding an acid catalyst such as acetic acid or sulphuric acid.

The fluorinated amino alcohol (II) and the ester (III) are generally used in substantially equimolar quantities. However, for esters (III) having low boiling point (for example methyl acrylate), it will be advantageous to use an excess of ester as solvent for the reaction. This excess, which can range up to 5 moles per mole of amino alcohol is, after the reaction, removed by distillation at atmospheric pressure or under vacuum.

The compounds of formula (I) in which $R_3$ is a long-chain ($C_5$–$C_{24}$) alkyl radical may also be prepared from a compound of formula (I) where $R_3$ is a lower ($C_1$–$C_4$) alkyl radical, by transesterification of the latter using a long-chain alcohol.

According to a particular embodiment of the invention, the condensation of the amino alcohol (II) with the ester (III) may be conducted with a deficit of ester (III), it being possible for this deficit to range up to one half of the theoretical quantity. A mixture comprising, in addition to the compound (I), up to 50% of the starting amino alcohol is then obtained. Such mixtures are also usable as anti-wear additives for lubricants, and hence form part of the present invention. The same applies to the more complex mixtures obtained from an industrial mixture of amino alcohols (II) and/or from an industrial mixture of esters (III).

As examples of esters of formula (III), methyl, n-butyl, 2-ethylhexyl, n-dodecyl, n-tetradecyl, n-hexadecyl and n-octadecyl acrylates or methacrylates may be mentioned more especially. The acrylates are preferred.

With the exception of those in which X denotes a—$CFHCH_2CH_2$— linkage, the amino alcohols (II) are known products. See, for example, French Patent Nos. 1,532,284 and its additions 93,170, 95,059 and 2,102,753, as well as U.S. Pat. No. 3,535,381. These products may be obtained by condensing an iodo derivative of formula:

$$R_F—(CH_2CF_2)_a(CH_2)_b—I \quad \text{(IV)}$$

with an amino alcohol of formula $$H_2N—CH_2\underset{\underset{R_1}{|}}{CH}—OH \quad \text{(V)}$$

$R_F$, a, b and $R_1$ having the same meanings as above. It is appropriate to point out that, when an iodide of the type $R_F—CH_2CH_2I$ is used, the condensation generally leads to a mixture of fluorinated amino alcohols of formulae:

$$R_F—CH_2CH_2—NH—CH_2\underset{\underset{R_1}{|}}{CH}—OH \quad \text{(II-a)}$$

and $$R'_F—CF{=}CH—CH_2NH—CH_2\underset{\underset{R_1}{|}}{CH}—OH \quad \text{(II-b)}$$

where $R'_F$ is a perfluorinated radical containing one carbon atom fewer than the radical $R_F$. It is, however, possible, if so desired, to separate these two amino alcohols by gas chromatography. It is also possible to prepare the saturated amino alcohol (II-a) selectively by using a large excess of amino alcohol (V). Similarly, the unsaturated amino alcohol (II-b) may be obtained selectively by condensing the amino alcohol (V) with a fluorinated olefin $R_F—CH{=}CH_2$ according to U.S. Pat. No. 3,535,381 cited above.

The fluorinated amino alcohols (II) in which X denotes a —$CFHCH_2CH_2$— linkage may be obtained by hydrogenation of the fluorinated amino alcohols (II-b).

This hydrogenation can be carried out, for example, in an alcohol (preferably in methanol or ethanol) in the presence of a catalyst such as Raney nickel or palladium on charcoal, at a temperature which can range from 25° to 250° C. (preferably between 50° and 150° C.), and under a hydrogen pressure which can reach 200 bars but is preferably between 5 and 100 bars.

This hydrogenation reaction may also be applied to a mixture of fluorinated amino alcohols (II-a) and (II-b) to obtain a mixture of saturated fluorinated amino alcohols.

The quantity of compound(s) of formula (I) to be incorporated in a lubricating oil to obtain optimal anti-wear efficacy is at least 0.01% with respect to the weight of the oil, and is preferably between 0.05 and 0.5%.

The lubricating oil can be a mineral oil, a synthetic hydrocarbon or a synthetic oil belonging to the following different families: glycols, glycol ethers, glycol esters, polyoxyalkylene glycols, their ethers and their esters, and esters of monocarboxylic or polycarboxylic acids and monohydric or polyhydric alcohols. This list is not limiting.

When petroleum cuts intended for the manufacture of engine oils, such as "Neutral Solvent" bases, are used as lubricant bases, the organofluorine derivatives of the invention are advantageously combined with traditional dispersant-detergent additives such as calcium or barium alkylphenates and alkylarylsulphonates, or "ashless" dispersants such as succinic derivatives. The dispersant-detergent additives promote the solubilization of the fluorinated additives in the oil without impairing the anti-wear properties of the latter additives and without losing their own power.

The addition of fluorinated derivatives according to the invention to formulated oils already containing additives such as zinc alkyldithiophosphates brings about a substantial improvement in the anti-wear power and an increase in the load-carrying ability of these oils without interfering with the properties conferred by the other additives: dispersivity, detergency, anti-corrosion power, for example.

The replacement of all or part of the zinc dithiophosphate used as an anti-wear additive in oil formulations for internal-combustion engines by 0.1 to 0.2% of organofluorine compounds according to the invention makes it possible to achieve a level of protection against wear which is equal to or greater than that obtained with this traditional additive.

The fluorinated additives according to the invention may hence be used either as a replacement for zinc alkyldithiophosphates in lubricating oils for petrol or diesel engines or an an extra additive in these oils.

EXAMPLES

The examples and tests which follow illustrate the invention without limiting it. The percentages are understood to be by weight, except where otherwise stated.

EXAMPLE 1

4 g of methyl acrylate are added with constant stirring to a solution of 20 g of a mixture of fluorinated amino alcohols $C_8F_{17}—CH_2CH_2—NH—CH_2CH_2OH$ and $C_7F_{15}CF{=}CHCH_2—NH—CH_2CH_2OH$ (65 and 35 mol %, respectively) in 10 g of ethanol in a 100-ml round-bottomed flask surmounted by a condenser. The mixture is then brought to reflux for 10 hours, after which the ethanol and excess methyl acrylate are removed by evaporation under vacuum.

The residue (22 g), characterized by infrared spectroscopy (ester band: 1,730 $cm^{-1}$), corresponds to the esters of formulae:

$$C_8F_{17}C_2H_4—\underset{\underset{C_2H_4OH}{|}}{N}—C_2H_4COOCH_3 \text{ and}$$

$$C_7F_{15}CF{=}CHCH_2—\underset{\underset{C_2H_4OH}{|}}{N}—C_2H_4COOCH_3$$

and takes the form of an orange liquid which is slightly turbid at room temperature but fully homogeneous at 60° C.

EXAMPLE 2

A solution containing 20 g of the same mixture of fluorinated amino alcohols as in Example 1, 5.55 g of n-butyl acrylate and 10 g of n-butanol is brought to 100° C. for 10 hours. The reaction mixture is then filtered, after which the solvent and excess butyl acrylate are evaporated off under vacuum.

The product obtained (23 g) corresponds to the esters of the formulae:

$$C_8F_{17}C_2H_4-\underset{\underset{C_2H_4OH}{|}}{N}-C_2H_4COOC_4H_9 \text{ and}$$

$$C_7F_{15}CF{=}CHCH_2-\underset{\underset{C_2H_4OH}{|}}{N}-C_2H_4COOC_4H_9$$

and takes the form of an orange liquid which is turbid at room temperature.

EXAMPLE 3

Example 2 is repeated, but with 0.1 g of acetic acid added. The reaction mixture is heated for only 6 hours.

The same product is obtained in a 91% yield.

EXAMPLE 4

11.4 g of lauryl acrylate are added with constant stirring to a solution of 23.72 g of the same mixture of fluorinated amino alcohols as in Example 1 in 10 g of n-butanol in the same apparatus as in Example 1. The mixture is then brought to 100° C. for 10 hours, after which the n-butanol is removed by evaporation under vacuum. The residue is taken up with dichloromethane. The solution is filtered. The dichloromethane is evaporated off.

The mixture of esters of formulae:

$$C_8F_{17}C_2H_4-\underset{\underset{C_2H_4OH}{|}}{N}-C_2H_4COOC_{12}H_{25} \text{ and}$$

$$C_7F_{15}CF{=}CHCH_2-\underset{\underset{C_2H_4OH}{|}}{N}-C_2H_4COOC_{12}H_{25}$$

thereby obtained takes the form of a clear orange liquid (32.7 g; yield: 93%).

EXAMPLE 5

20 g of methyl acrylate and 20 g of an industrial mixture of fluorinated amino alcohols of formulae:

$C_nF_{2n+1}CH_2CH_2-NH-CH_2CH_2OH$ and $C_{n-1}F_{2n-1}CF{=}CHCH_2-NH-CH_2CH_2OH$ where n equals 6, 8, 10, 12 and 14 in respective percentages by weight of 56.2%, 27.2%, 12.3%, 3.7% and 0.6%, are heated to 80° C. with stirring for 8 hours. The industrial mixture, whose average molecular mass is 466, contains approximately 65 mol % of saturated amino alcohols and 35 mol % of unsaturated amino alcohols.

After evaporation of the excess methyl acrylate, a mixture of the esters of formulae:

$$C_nF_{2n+1}C_2H_4-\underset{\underset{C_2H_4OH}{|}}{N}-C_2H_4COOCH_3 \text{ and}$$

$$C_{n-1}F_{2n-1}CF{=}CHCH_2-\underset{\underset{C_2H_4OH}{|}}{N}-C_2H_4COOCH_3$$

is obtained in a 91.3% yield in the form of a clear yellow liquid, which is characterized by IR spectroscopy (ester band: 1,730 $cm^{-1}$).

EXAMPLE 6

The procedure is as in Example 2, but with the $C_8F_{17}$ and $C_7F_{15}$ amino alcohols replaced by 20 g of the industrial mixture of fluorinated amino alcohols defined in Example 5, and 6 g of butyl acrylate being used.

24.05 g of a clear liquid are thereby obtained, corresponding to the esters of formulae:

$$C_nF_{2n+1}C_2H_4-\underset{\underset{C_2H_4OH}{|}}{N}-C_2H_4COOC_4H_9 \text{ and}$$

$$C_{n-1}F_{2n-1}CF{=}CHCH_2-\underset{\underset{C_2H_4OH}{|}}{N}-C_2H_4COOC_4H_9$$

EXAMPLE 7

7.9 g of 2-ethylhexyl acrylate are added with constant stirring to a solution of 20 g of the industrial mixture of fluorinated amino alcohols defined in Example 5 in 10 g of n-butanol in a 100-ml Erlenmeyer equipped with a condenser. The mixture is then heated to 80° C. for 8 hours.

After removal of the n-butanol by evaporation under vacuum, a clear yellow liquid consisting of the esters of formulae:

$$C_nF_{2n+1}C_2H_4-\underset{\underset{C_2H_4OH}{|}}{N}-C_2H_4COOCH_2\underset{\underset{C_2H_5}{|}}{CH}-C_4H_9$$

and $$C_{n-1}F_{2n-1}CF{=}CHCH_2-\underset{\underset{C_2H_4OH}{|}}{N}-C_2H_4COOCH_2\underset{\underset{C_2H_5}{|}}{CH}-C_4H_9$$

is obtained in a 95% yield.

EXAMPLE 8

The procedure is as in Example 4, but with the $C_8F_{17}$ and $C_7F_{15}$ amino alcohols replaced with 20 g of the industrial mixture of fluorinated amino alcohols defined in Example 5.

A mixture consisting of the esters of formulae:

$$C_nF_{2n+1}C_2H_4-\underset{\underset{C_2H_4OH}{|}}{N}-C_2H_4COOC_{12}H_{25} \text{ and}$$

$$C_{n-1}F_{2n-1}CF{=}CHCH_2-\underset{\underset{C_2H_4OH}{|}}{N}-C_2H_4COOC_{12}H_{25}$$

is obtained in a 92% yield.

EXAMPLE 9

To a flask containing 6.18 g of the industrial mixture of fluorinated amino alcohols defined in Example 5, a deficit of n-butyl acrylate (1.09 g, equivalent to approximately 0.65 molar equivalent) and 9 g of methanol are added. The mixture is then left with stirring and at room temperature for 96 hours.

After evaporation of the methanol, a product is obtained which is turbid at room temperature but becomes homogeneous at about 60° C. This product consists, in the proportion of approximately 60 mol %, of a mixture of esters of formulae:

$C_nF_{2n+1}C_2H_4-\underset{\underset{C_2H_4OH}{|}}{N}-C_2H_4COOC_4H_9$ and $C_{n-1}F_{2n-1}CF{=}CHCH_2-\underset{\underset{C_2H_4OH}{|}}{N}-C_2H_4COOC_4H_9$ and in the proportion of approximately 40 mol %, of a mixture of unreacted fluorinated amino alcohols.

EXAMPLE 10

Example 9 is repeated, but with 1.42 g of n-butyl acrylate (0.847 molar equivalent) being used. A similar product is obtained in a 90% yield.

EXAMPLE 11

(a) A 4-liter stainless steel autoclave equipped with a magnetically driven stirring system is charged with 2,000 g of a mixture of fluorinated amino alcohols $C_8F_{17}-CH_2CH_2-NH-CH_2CH_2OH$ and $C_7F_{15}-CF{=}CH-CH_2-NH-CH_2CH_2OH$ (67 mol % and 33 mol %, respectively), followed by 1.2 liter of 99% pure ethanol and 32 g of an approximately 60% strength suspension of Raney nickel in 99% strength ethanol.

The autoclave is then purged three times with nitrogen under 30 bars, and thereafter three times with hydrogen under 30 bars. The mixture is then hydrogenated for 6 hours 45 minutes at 70° C., while stirring at 2,000 rpm and maintaining the pressure at 20 bars. After the autoclave has been cooled, the pressure released and the autoclave purged, the catalyst is filtered off and the ethanol then evaporated off.

1,940 g of a pale yellow solid product, melting point 51° C., are thereby obtained, the GC analysis of which gives the following results:

$C_8F_{17}-CH_2CH_2-NH-CH_2CH_2OH$ . . . 65.6%

$C_7F_{15}-CFH-CH_2CH_2-NH-CH_2CH_2OH$ . . . 25.4%

$C_7F_{15}-CH_2CH_2CH_2-NH-CH_2CH_2OH$ . . . 8.9%

(b) 1.87 g of n-butyl acrylate are added with constant stirring to a solution of 6.27 g of the mixture of saturated fluorinated amino alcohols obtained above in 10 g of n-butanol in a 100-ml Erlenmeyer surmounted by a condenser. The mixture is then brought to 100° C. for 10 hours, after which n-butanol and the excess butyl acrylate are removed by evaporation. The yellow residue is dissolved in dichloromethane. The solution is filtered. The dichloromethane is evaporated off.

The mixture of esters of formulae:

$C_8F_{17}C_2H_4-\underset{\underset{C_2H_4OH}{|}}{N}-C_2H_4COOC_4H_9$, $C_7F_{15}CFHCH_2-CH_2-\underset{\underset{C_2H_4OH}{|}}{N}-C_2H_4COOC_4H_9$ and $C_7F_{15}C_3H_6-\underset{\underset{C_2H_4OH}{|}}{N}-C_2H_4COOC_4H_9$ thereby obtained in a 96% yield takes the form of a yellow liquid, which is characterized by IR spectroscopy (ester band at 1,725 $cm^{-1}$).

EXAMPLE 12

(a) Working as in Example 11-a, 2,000 g of an industrial mixture of fluorinated amino alcohols of formulae:

$C_nF_{2n+1}-CH_2CH_2-NH-CH_2CH_2OH$(67 mol%) and $C_{n-1}F_{2n+1}-CF{=}CH-CH_2-NH-CH_2CH_2OH$ (33 mol%)

in which the distribution by weight of the fluorinated chains is as follows:

| n | % |
|---|---|
| 6 | 55.7 |
| 8 | 27.2 |
| 10 | 10.15 |
| 12 | 3.9 |
| ≧14 | 2.9 |

is hydrogenated for 9 hours at 80° C.

1,990 g of a semi-liquid, semi-solid pale yellow product (completely liquid at 45° C.) are obtained. The GC analysis of which gives the following results:

$C_nF_{2n+1}-CH_2CH_2-NH-CH_2CH_2OH$ . . . 69.3%

$C_{n-1}F_{2n-1}-CFH-CH_2CH_2-NH-CH_2CH_2OH$ . . . 18.6%

$C_{n-1}F_{2n-1}-CH_2CH_2CH_2-NH-CH_2CH_2OH$ . . . 9.8%

(b) 2 05 g of 2-ethylhexyl acrylate are added to 5.5 g of this mixture of saturated fluorinated amino alcohols. The mixture is then brought to 100° C. for 8 hours.

A clear orange liquid consisting of the esters of formulae:

$C_nF_{2n+1}C_2H_4-\underset{\underset{C_2H_4OH}{|}}{N}-C_2H_4COOCH_2\underset{\underset{C_2H_5}{|}}{CH}-C_4H_9$ $C_{n-1}F_{2n-1}CFHCH_2CH_2-\underset{\underset{C_2H_4OH}{|}}{N}-C_2H_4COOCH_2\underset{\underset{C_2H_5}{|}}{CH}-C_4H_9$ and $C_{n-1}F_{2n-1}CH_2CH_2CH_2-\underset{\underset{C_2H_4OH}{|}}{N}-C_2H_4COOCH_2\underset{\underset{C_2H_5}{|}}{CH}-C_4H_9$ is thereby obtained in a 93% yield.

EXAMPLE 13

Example 12-b is repeated, but with 2-ethylhexyl acrylate replaced by 3.3 g of lauryl acrylate, and 6.87 g of the mixture of saturated fluorinated amino alcohols obtained in Example 12-a being used.

The mixture of lauryl esters thereby obtained (yield: 92%) takes the form of a clear yellow liquid.

EXAMPLE 14

1.56 g (0.85 molar equivalent) of n-butyl acrylate are added to 6.73 g of the mixture of saturated fluorinated amino alcohols obtained in Example 12-a in 12 g of a mixture (3:1) of ether and acetonitrile in a 250-ml Erlenmeyer surmounted by a condenser. The mixture is then left with stirring at room temperature for 96 hours, after which the solvents are removed by distillation under vacuum.

7.5 g of a clear yellow liquid are thereby recovered, consisting, in the proportion of approximately 20 mol %, of the starting saturated fluorinated amino alcohols, and, in the proportion of approximately 80 mol %, of the butyl esters of these amino alcohols.

ANTI-WEAR TESTS

The anti-wear power of lubricant compositions, containing the mineral oil 200 Neutral Solvent as base oil and compound having a fluorinated chain according to the invention as additive, is determined using the SHELL EP 4 ball machine. The description of which appears in the "Annual Book of ASTM Standards", Part 24, pages 680 to 688 (1979).

The test consists in rotating a ball 12 mm in diameter with a speed of rotation of 1,500 rpm on three other balls held immobile and covered with test lubricant. A load of 40 or 70 daN is applied by a lever system, which pushes the three fixed balls towards the upper ball placed in a chuck.

The anti-wear efficacy of a lubricant is determined by the mean value of the diameters of the wear marks on the three fixed balls after one hour's operation.

Table I below collates the results obtained with different fluorinated additives according to the invention, which are identified in the form of Fx where x corresponds to the number of the Example describing the preparation of the fluorinated additive which, in all cases, is tested at the proportion by weight of 0.1%

TABLE I

| Fluorinated additive | Diameter of wear mark in mm for an applied load of | |
|---|---|---|
| | 40 daN | 70 daN |
| None (control) | 1.44 | 2.37 |
| F 1 | 0.72 | 0.78 |
| F 2 | 0.65 | 0.79 |
| F 3 | 0.66 | 0.72 |
| F 4 | 0.62 | 0.73 |
| F 5 | 0.64 | 0.81 |
| F 6 | 0.41 | 0.72 |
| F 7 | 0.45 | 0.68 |
| F 9 | 0.51 | 0.63 |
| F 10 | 0.41 | 0.69 |
| F 14 | 0.39 | 0.55 |

THERMAL STABILITY TESTS

To test their behavior under conditions similar to those existing in an engine, the fluorinated compounds according to the invention are subjected to as gravimetric thermal analysis under air. This test consists in subjecting a sample of product to a temperature rise (2° C./min) under a current of air at 10 l/h, and recording the percentage weight losses at 200°, 250° and 300° C.

Table II below collates the results obtained. By way of comparison, the behavior of the following fluorinated compounds, recommended in the prior art (French Patent No. 2,520,377), is shown at the beginning of the table:

P1: $C_8F_{17}$—$C_2H_4$—NH—$C_2H_4OH$

P2: $C_nF_{2n+1}$—$C_2H_4$—NH—$C_2H_4OH$ (n defined as in Example 5 above)

TABLE II

| Fluorinated additive | Loss in weight (%) at: | | |
|---|---|---|---|
| | 200° C. | 250° C. | 300° C. |
| P 1 | 80 | 94.6 | 97 |
| P 2 | 78.7 | 96.5 | 98.2 |
| F 3 | 16.3 | 85.5 | 96.9 |
| F 4 | 7.7 | 33.1 | 83.7 |
| F 5 | 25 | 87.5 | 95 |
| F 6 | 15 | 71.2 | 94.6 |

TABLE II-continued

| Fluorinated additive | Loss in weight (%) at: | | |
|---|---|---|---|
| | 200° C. | 250° C. | 300° C. |
| F 7 | 16.2 | 70 | 91.8 |
| F 8 | 5.6 | 24.3 | 81.8 |
| F 11 | 21.2 | 71.9 | 94.4 |
| F 12 | 12.1 | 48.1 | 93.1 |
| F 13 | 5.8 | 23.1 | 75.6 |

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

All preceding references are hereby incorporated by reference.

We claim:

1. Polyfluorinated compound, comprising the general formula:

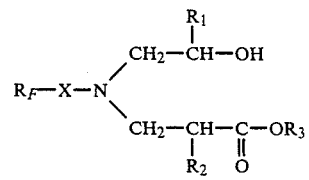

(I)

in which:

$R_F$ denotes a perfluorinated radical,

X denotes a divalent linkage $—(CH_2CF_2)_a(CH_2)_b—$, $—CF{=}CHCH_2—$ or $—CFHCH_2CH_2—$, a being an integer ranging from 0 to 10, and b an integer which can range from 1 to 4 but is equal to 2 when a is other than 0, $R_1$ denotes a hydrogen atom or a linear or branched alkyl radical containing from 1 to 12 carbon atoms, $R_2$ denotes a hydrogen atom or methyl radical, and $R_3$ denotes a linear or branched alkyl radical containing from 1 to 24 carbon atoms.

2. The compounds according to claim 1, wherein $R_F$ is a linear or branched perfluoroalyl radical containing from 2 to 20 carbon atoms and $R_2$ is a hydrogen atom.

3. The compounds according to claim 1, wherein $R_F$ is a linear perfluoroalkyl radical containing from 6 to 16 carbon atoms, X is a linkage $—CH_2CH_2—$, $—CF{=}CHCH_2—$ or $—CFHCH_2CH_2—$, $R_1$ and $R_2$ are hydrogen atoms and $R_3$ is an alkyl radical containing from 8 to 18 carbon atoms.

4. A mixture of compounds according to claim 1, wherein the groups $R_F$, X and/or $R_3$ are different.

5. A mixture comprising one or more compounds according to claim 1 and up to 50% of one or more amino alcohols of the formula:

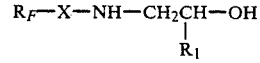

(II)

in which the symbols $R_F$, X and $R_1$ have the same meanings as in claim 1.

6. A process for preparing polyfluorinated compounds or mixtures of such compounds, comprising condensing at a temperature between about 20° and 100° C. an amino alcohol of formula:

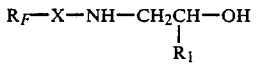

(II)

or a mixture of such amino alcohols, with from about 0.5 to about 1 molar equivalent of an acrylic ester of formula:

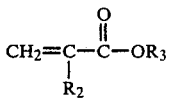

(III)

or a mixture of such esters, the symbols $R_F$, X, $R_1$, $R_2$ and $R_3$ having the same meanings as in claim 1.

7. The process according to claim 6, further comprising performing the condensation in a lower ($C_1$–$C_4$) alcohol.

8. The process according to claim 7, further comprising performing the condensation at a temperature between 20° and 80° C.

9. The process for preparing compounds according to claim 1 in which $R_3$ is a long-chain ($C_5$–$C_{24}$) alkyl radical, comprising transesterifying in a conventional manner a compound according to claim 1 in which $R_3$ is a lower ($C_1$–$C_4$) alkyl radical using a long-chain alcohol.

10. A method for improving the anti-wear properties of a lubricant oil comprising incorporating therein at least one polyfluorinated compound according to claim 1.

11. Lubricants comprising a lubricates oil and a polyfluorinated compounds or a mixture of polyfluorinated compounds according to claim 1.

12. The lubricants according to claim 11, wherein the content of polyfluorinated compound(s) is at least 0.01% by weight.

13. The lubricants according to claim 12, wherein the content of polyfluorinated compound(s) is between 0.05 and 0.5% by weight.

14. The lubricants according to claim 11, wherein the polyfluorinated compound or compounds are combined with conventional additives.

15. The process according to claim 1, further comprising acrylic esters having a low boiling point.

16. The process according to claim 15, wherein the acrylic ester is methyl acrylate.

17. The process according to claim 15, further comprising an excess of ester as solvent which can range up to 5 moles per mole of amino alcohol.

18. The process according to claim 17, further comprising removing the solvent after preparation of the compounds by distillation.

* * * * *